United States Patent [19]

Neuroth

[11] Patent Number: 4,780,574

[45] Date of Patent: Oct. 25, 1988

[54] LEAD SHEATHED POWER CABLE

[75] Inventor: David H. Neuroth, Hamden, Conn.

[73] Assignee: Hubbell Incorporated, Orange, Conn.

[21] Appl. No.: 38,926

[22] Filed: Apr. 16, 1987

[51] Int. Cl.[4] ..... H01B 7/20

[52] U.S. Cl. ..... 174/102 D; 156/52; 156/56; 174/105 R; 174/107

[58] Field of Search ..... 174/102 R, 102 D, 103, 174/105 R, 106 D, 107, 113 R, 116; 156/51, 52, 56

[56] References Cited

U.S. PATENT DOCUMENTS

| | | | |
|---|---|---|---|
| 1,947,455 | 2/1934 | Bennett | 174/103 |
| 2,203,232 | 6/1940 | Osborne et al. | 174/105 R |
| 2,216,435 | 10/1940 | Eckel | 174/105 R |
| 2,544,233 | 3/1951 | Kennedy | 174/117 R |
| 2,658,014 | 3/1953 | Morrison | 174/113 R |
| 2,690,984 | 10/1954 | Crandall et al. | 174/107 |
| 2,727,087 | 12/1955 | Hull | 174/109 |
| 2,930,837 | 3/1960 | Thompson | 174/115 |
| 3,413,408 | 11/1968 | Robinson | 174/121 R |
| 3,485,224 | 12/1969 | Ronald | 174/116 |
| 3,566,009 | 2/1971 | Lamond et al. | 174/102 R |
| 3,638,306 | 2/1972 | Padowicz | 174/105 R X |
| 3,717,718 | 2/1973 | Schmidtchen | 174/106 D |
| 3,742,363 | 6/1973 | Carle | 174/102 R |
| 3,809,802 | 5/1974 | Pearson | 174/103 |
| 3,832,481 | 8/1974 | Boyd et al. | 174/102 R |
| 4,284,841 | 8/1981 | Tijunelis et al. | 174/103 |
| 4,567,320 | 1/1986 | Neuroth et al. | 174/103 |
| 4,572,926 | 2/1986 | Ganssle et al. | 174/103 |
| 4,595,431 | 6/1986 | Bohannon, Jr. et al. | 174/102 R X |
| 4,675,474 | 6/1987 | Neuroth | 174/113 R X |

*Primary Examiner*—Morris H. Nimmo

*Attorney, Agent, or Firm*—Jerry M. Presson; Alfred N. Goodman

[57] ABSTRACT

A lead sheathed power cable especially useful for powering electric submersible pumps in brine wells. The cable is easy to grip and support and resists damage during flexing and chemical attack. The cable comprises at least one power conduit, vulcanized filler material enclosing the power conduit, a lead tube enclosing the filler material, a spacer assembly enclosing the tube, and an outer armor sheath. The armor sheath has a helically grooved inner surface which is interfitted with a conforming helically grooved outer surface on the malleable tube. The outer surface on the tube is helically grooved during initial heating of the cable, which vulcanizes and thermally outwardly expands the filler material and outwardly expands the tube so that the groove on the armor sheath is impressed into the tube. The spacer assembly comprises at least one bedding tape formed of a fabric backing tape with rubber carried thereon and is used to space the outer surface of the tube from the inner surface of the sheath to facilitate flexing of the cable.

24 Claims, 3 Drawing Sheets

LEAD SHEATHED POWER CABLE

FIELD OF THE INVENTION

The invention relates to reinforced power cables, especially lead sheathed electric cables used to power submersible pumps in brine wells.

BACKGROUND OF THE INVENTION

Electric submersible pumps are often used in the chemical industry to pump large quantities of brine from wells deep in the earth. The brine contains valuable chemicals which are removed and processed. Since the brine is often very highly corrosive, the electric power cables used to deliver power to the submerged pump motors in the wells are subject to deterioration and require replacement at regular intervals.

To resist this corrosion, the electric cables are often highly reinforced and layered. The most common means of constructing such cables is by using one or more layers of extruded lead, fiber reinforced tape, and polymeric layers.

However, use of such heavily leaded and layered cables presents significant problems. One is that the lead layer is difficult to support in the vertical position when gripping is applied to the outer armor layer of the cable. The lead layer is particularly subject to slipping with respect to the armor. In addition, the lead layer is subject to flex creaking induced by bending of the cable. Finally, it is also slowly attacked by the chemicals in the brine.

Examples of typical reinforced power cables are disclosed in the following U.S. Pat. Nos. 2,544,233 to Kennedy; 2,690,984 to Crandall et al; 2,727,087 to Hull; 2,930,837 to Thompson; 3,413,408 to Robinson; 3,566,009 to Lamond et al; 3,832,481 to Boyd et al; 4,284,841 to Tijunelis et al; 4,567,320 to Neuroth et al; and 4,572,926 to Ganssle et al. Also disclosing a reinforced power cable is commonly assigned U.S. patent application Ser. No. 772,413 filed Sept. 4, 1985 for Reinforced Electrical Cable and Method of Forming the Cable in the name of David H. Neuroth, the inventor herein.

Thus, there is a continuing need for improvement in reinforced power cables, especially electric cables used to power submersible pumps in brine wells.

SUMMARY OF THE INVENTION

Accordingly, a primary object of the invention is to provide an improved reinforced power cable that is resistant to the corrosive effects of brine.

Another object of the invention is to provide a reinforced power cable that is easy to grip and support in a well without significant relative movement between the various components thereof.

A further object of the invention is to provide a reinforced power cable that is resistant to damage during flexing and to chemical attack.

A further object of the invention is to provide a reinforced power cable where an inner malleable tube of lead is interfitted with the outer armor sheath.

A further object of the invention is to provide a reinforced power cable having a lead tube therein and vulcanized bedding tape located between the lead tube and the outer armor sheath.

The foregoing objects are basically attained by providing a reinforced power cable comprising a continuous armor sheath having a contoured inner surface defining a cavity therein, the armor sheath having a longitudinal axis and being substantially rigid transversely of the longitudinal axis; a power conveying means, located in the cavity and extending along the longitudinal axis, for transmitting power; a filler assembly enclosing and engaging the power conveying means; a continuous malleable tube having an inner surface and an outer surface, the tube inner surface enclosing and engaging the filler assembly, the tube outer surface being inwardly spaced from the armor sheath inner surface and being contoured, the tube contoured outer surface having substantially the same configuration as the armor sheath contoured inner surface and being interfitted therewith; and a spacer assembly, interposed between and engaging the tube outer surface and the armor sheath inner surface, for maintaining the tube outer surface inwardly spaced from the armor sheath inner surface.

The foregoing objects are also basically attained by providing a method of making a reinforced power cable comprising the steps of enclosing a power conveying means with vulcanizable filler material, enclosing the filler material with a continuous malleable tube, enclosing the malleable tube with a continuous, substantially transversely rigid armor sheath having a contoured inner surface, heating the power conveying means, filler material, malleable tube and armor sheath, thereby thermally outwardly expanding and vulcanizing the filler material, and outwardly expanding the malleable tube under the influence of the expanding filler material so that the contour on the inner surface of the armor sheath is impressed into the outer surface of the malleable tube, and cooling the power conveying means, filler material, malleable tube and armor sheath.

Advantageously, this method of making the reinforced power cable includes, following the second enclosing step, the step of enclosing the malleable tube with a bedding tape.

Other objects, advantages and salient features of the present invention will become apparent from the following detailed description, which, taken in conjunction with the annexed drawings, discloses a preferred embodiment of the invention.

DRAWINGS

Referring now to the drawings which form a part of this original disclosure:

Figure 3:
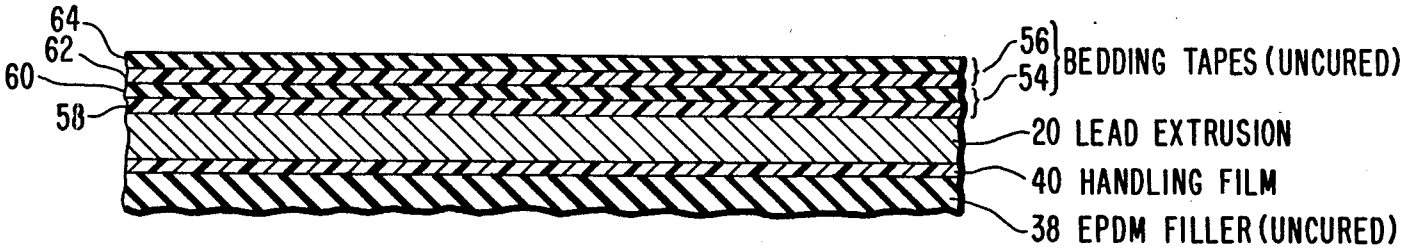
FIG. 3 is an enlarged, fragmentary side elevational view in longitudinal section showing various layers of the power cable during the initial steps in forming the cable.
Figure 4:
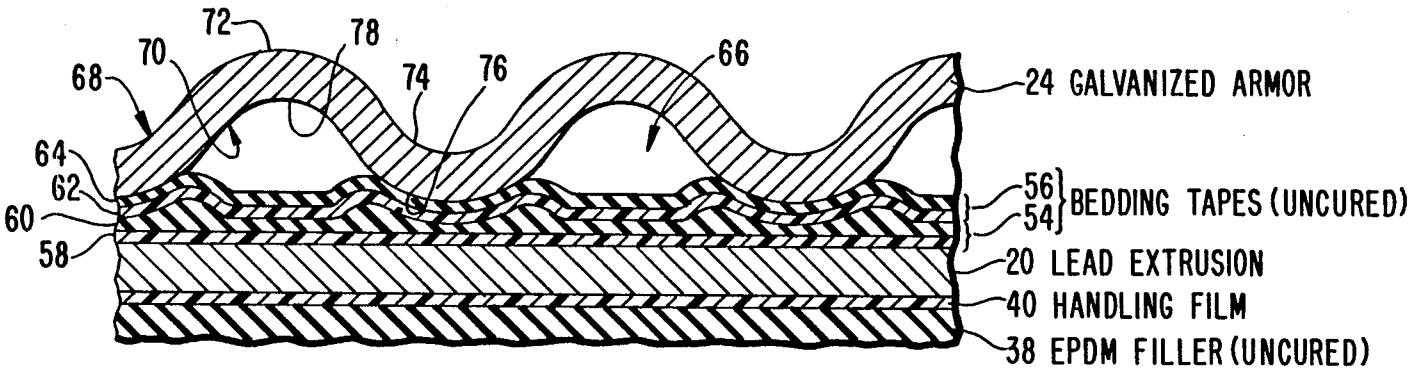
Figure 5:
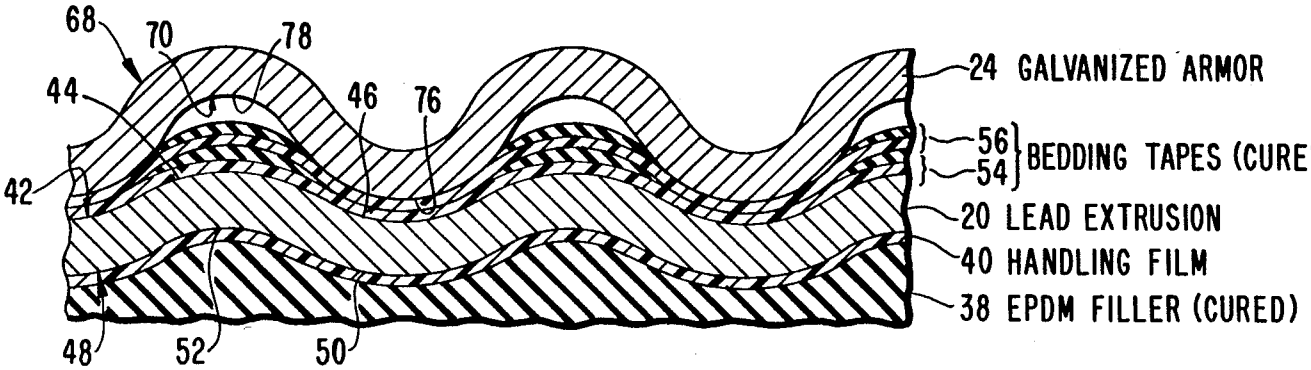

FIG. 4 is an enlarged, fragmentary side elevational view of the power cable in longitudinal section similar to thjat shown in FIG. 3, except that the outer armor sheath has been firmly wrapped around the various layers and deforms parts of the bedding tapes located thereon; and FIG. 5 is an enlarged, fragmentary side elevational view of the power cable in longitudinal section similar to that shown in FIG. 4, except that the various layers have undergone heating, thereby thermally outwardly expanding and vulcanizing the filler material and outwardly expanding the malleable lead tube under the influence of the expanding filler material so that the contour on the inner surface of the armor sheath is impressed into the outer surface of the malleable tube.

DETAILED DESCRIPTION OF THE INVENTION

Referring now to FIGS. 1–5, the reinforced power cable 10 in accordance with the invention comprises three power conduits, or power conveying lines, 12, 14 and 16, a filler assembly 18, a malleable lead tube 20, a spacer assembly 22, an armor sheath 24 and an outer cover 26. During manufacture, the various components and layers of the power cable are heated, thereby thermally outwardly expanding and vulcanizing the filler assembly 18, and outwardly expanding the malleable lead tube 20 under the influence of the expanding filler assembly so that a helically grooved contour on the inner surface of the armor sheath 24 is impressed into the outer surface of the malleable tube. Thus, the malleable tube and armor sheath are interfitted and therefore relative movement therebetween is resisted. Since the contour on the malleable tube essentially comprises a helical groove, the malleable tube is easily flexed during bending, thereby avoiding flex creaking. Since the spacer assembly 22 is interposed between the armor sheath and the lead tube and comprises vulcanized rubber, the power conduits and lead tube are protected from chemical attack.

The reinforced power cable 10 is advantageously circular in outer cross section and has an outer diameter of about 1.65 inches. While three power conduits are shown, more or less can be used. These conduits can be electrical, hydraulic, pneumatic, or combinations thereof. The three power conduits as seen best in FIG. 2 are centered in the cable, engage one another, and are configured in a triangular array.

Figure 1:
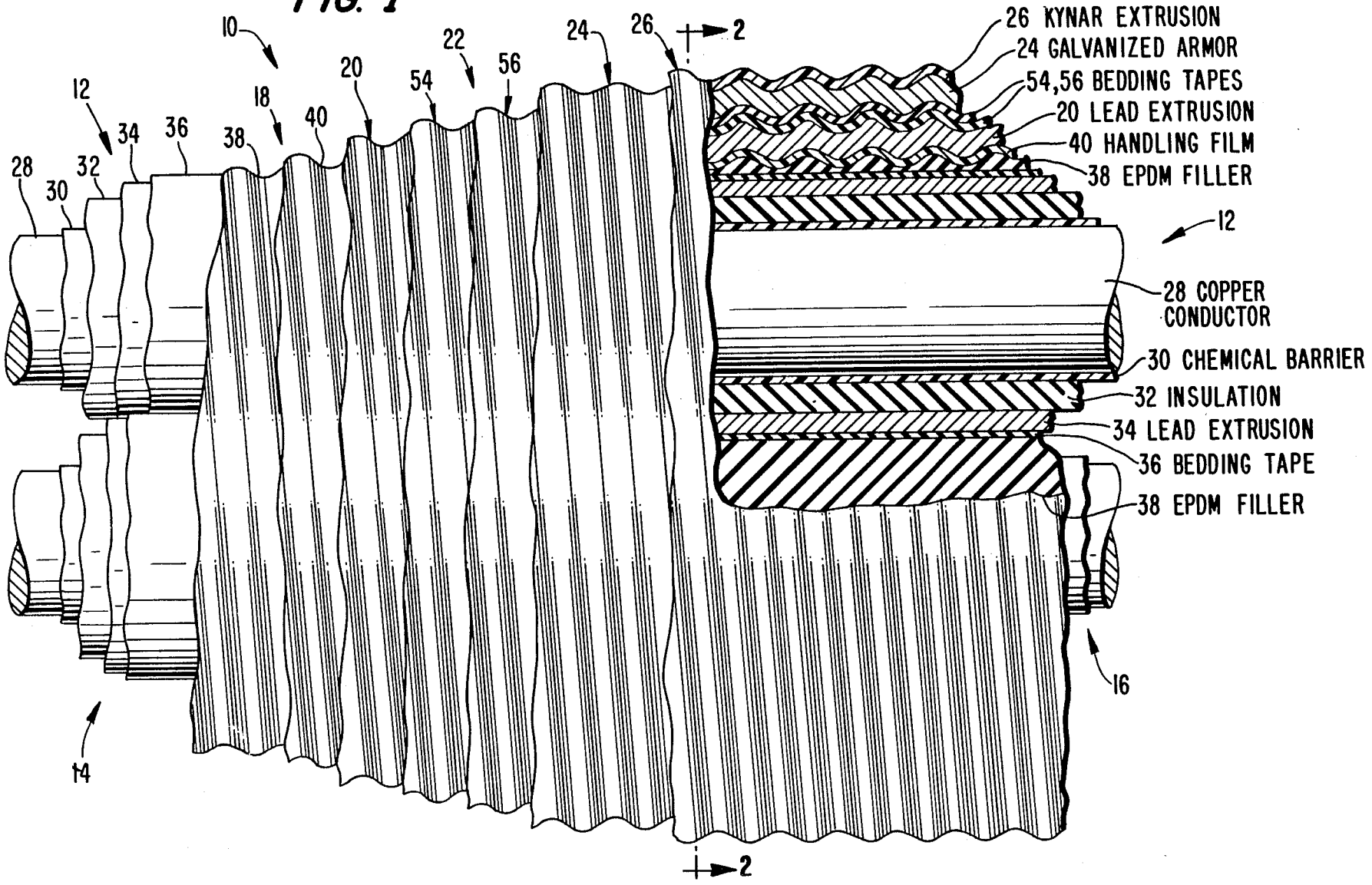
FIG. 1 is a side elevational view in partial section diagrammatically showing the reinforced power cable in accordance with the invention.
Figure 2:
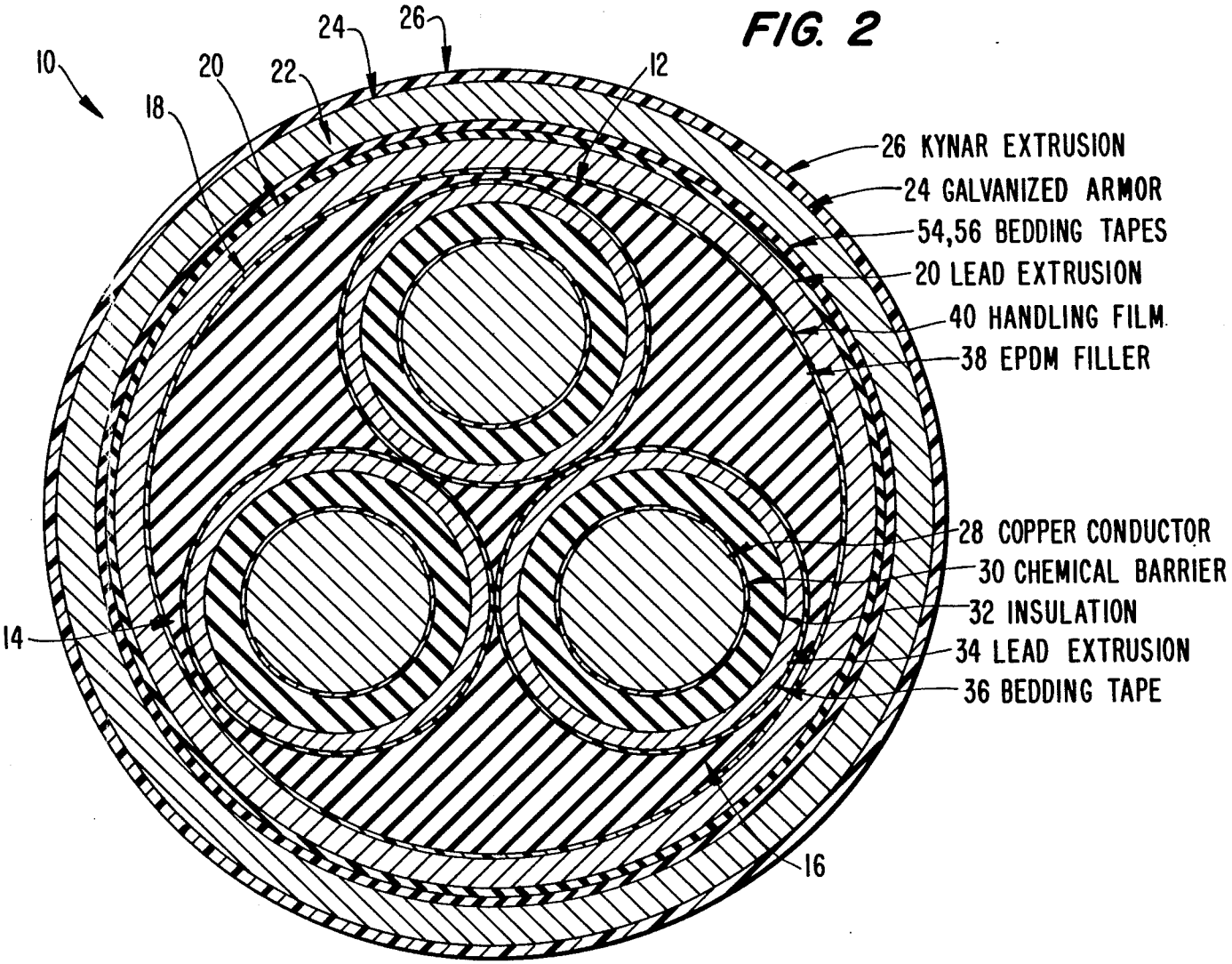
FIG. 2 is an end elevational view in transverse cross section of the reinforced power cable shown in FIG. 1 taken along line 2—2 in FIG. 1.

As seen in FIGS. 1 and 2, each of the three power conduits 12, 14 and 16 are similarly constructed and therefore only one will be described in detail. Thus, for example, power conduit 12 is comprised of a solid copper conductor 28, a tubular chemical barrier layer 30, a tubular layer of insulation 32, which can be rubber, a lead tube 34, and a bedding tape 36. The chemical barrier layer 30 can be formed of Kynar polyvinylidene fluoride. The layer of insulation 32 is preferably cured before it is used in making up the cable. The lead tube 34 is advantageously a cylindrical extrusion, has a continuous cross section, and is about 0.045 inch thick. The bedding tape 36 is formed from a fabric backing tape made of, for example, polypropylene, impregnated and coated with rubber, which is preferably uncured when applied, although it could be in the cured state.

The filler assembly 18 is comprised of filler material 38 and a handling film 40. The filler material can be formed, for example, from rubber or ethylenepropylenediene monomer terpolymer (EPDM). This material is applied initially in the uncured, i.e., unvulcanized, state and is ultimately vulcanized during manufacture of the power cable. The handling film 40 is essentially a plastic tube used to facilitate manufacture of the power cable and encloses the uncured, flowable filler material 38 and the three power conduits prior to their being covered by the lead tube 20. This film is optional and may be omitted when the uncured EPDM filler material has been formulated to prevent it sticking to itself during subsequent handling operations.

The malleable lead tube 20 is preferably formed as an extrusion firmly gripping the handling film 40, has a continuous cross section and is cylindrical with a wall thickness of about 0.060 inch thick. Since the lead tube 20 is malleable and has a low elastic limit, when it is outwardly deformed during the manufacturing process of the cable it will tend to exceed its elastic limit and maintain its deformed shape.

Referring to FIG. 5, the deformed malleable tube 20 is shown having an outer surface 42 which is contoured in the form of a helical groove defining a corrugation comprising a helical ridge 44 and a helical recess 46 adjacent to the ridge. Likewise, the malleable tube 20 has an inner surface 48 which is contoured in the form of a helical groove defining a corrugation comprised of a helical ridge 50 and a helical recess 52 adjacent to the ridge. The inner surface 48 of the malleable tube 20 encloses and tightly engages the outer surface of the filler assembly 18 formed by the handling film 40. As described in more detail hereinafter, the outer surface 42 of the malleable tube 20 is spaced from the inner surface of the armor sheath 24 and has substantially the same helically grooved contour as the inner surface of the armor sheath.

The spacer assembly 22, as seen in FIGS. 1–5, comprises first and second flexible bedding tapes 54 and 56. Bedding tape 54 is comprised of a fabric backing tape 58 formed from nylon, cotton or polyester, and a rubber layer 60 located thereon and impregnated therein. Initially, the rubber is uncured but is cured during manufacture of the cable. Similarly, bedding tape 56 is comprised of a fabric backing tape 62 and a rubber layer 64. Due to drawing space limitations, in FIGS. 1 and 2 the bedding tapes 54 and 56 are shown as each comprising only one layer, whereas more accurately in the enlarged FIGS. 3–5, each of the bedding tapes 54 and 56 is shown as comprising two layers, that is, a fabric backing tape 58 or 62 and a rubber layer 60 or 64.

Engaging and enclosing the bedding tapes 54 and 56 is the armor sheath 24 which is preferably formed from galvanized steel and is helically wrapped tightly over the bedding tapes. The armor sheath has a wall thickness of about 0.020 to about 0.034 inch, has a continuous, i.e., closed, circular cross section and is substantially rigid transversely thereof but bendable about its transverse axes. The armor sheath has a coefficient of thermal expansion less than the coefficient of thermal expansion of the malleable tube. The armor sheath defines a cavity 66 therein, as shown in FIG. 4, and has a longitudinal axis along which the power conduits 12, 14 and 16 extend as seen in FIGS. 1 and 2.

As seen in FIGS. 4 and 5, the armor sheath has an outer surface 68 and an inner surface 70. Both of these surfaces are contoured, each by a continuous helical groove. The contoured helical groove defining corrugation in the outer surface 68 is comprised of a helical ridge 72 and a helical recess 74 adjacent to the ridge. The contoured helical groove on the inner surface 70 is comprised of a helical ridge 76 and a helical recess 78 adjacent to the ridge. As will be described in more detail hereinafter, the contoured inner surface of the armor sheath 24 in the form of the helical groove substantially conforms to the contoured outer surface in the form of a helical groove on the malleable lead tube 20. Moreover, these grooves are aligned and thus the helical ridge on the malleable tube is received in the helical recess in the inner surface of the armor sheath and the helical ridge on the inner surface of the armor sheath is received in the helical recess in the outer surface of the malleable tube as seen most clearly in FIG. 5. (This is not illustrated in FIG. 1 due to drawing size limitations.) Such a configuration is termed "interfitting" or "interlocking" and means that one part fits into the other but these parts are not in contact. As also used herein, the term "contoured" means having a regular or irregular pattern of ridges and recesses, and more specifically, a helical groove comprised of a helical ridge and a helical recess.

While the wall of the armor sheath is shown continuous, this is merely a diagrammatic representation. In actuality, since the armor sheath is applied as a helical wrap, there are slight overlaps between adjacent windings. However, this does result in "continuous" inner and outer surfaces for the purposes of this invention.

As seen in FIGS. 1 and 2, the outer surface 68 of the armor sheath can be provided with a polymeric outer cover 26 formed advantageously of a Kynar polyvinylidene fluoride extrusion. This outer cover is applied in such a way as to conform to the outer configuration of the armor sheath 24.

METHOD OF CONSTRUCTING THE CABLE

The reinforced power cable 10 shown in FIGS. 1 and 2 in accordance with the invention is constructed via several steps best illustrated in FIGS. 3–5.

First, the three power conduits 12, 14 and 16 are constructed as illustrated in FIGS. 1 and 2 and are placed in a triangular array as seen in FIG. 2. The layers of insulation are preferably already vulcanized, while the bedding tapes are preferably unvulcanized.

Then, as seen in FIG. 2, the filler material 38 is placed on the outside of the conduits and therebetween and the handling film 40, if employed, is enclosed and engaged around the outside of the filler material 38, preferably without engaging the conduits. In enclosing and engaging the power conduits with the filler material 38, the material is in its unvulcanized state.

Next, as seen in FIG. 3, the malleable lead tube 20 is enclosed and engaged firmly around the handling film, preferably by extrusion. In this step, the lead tube has smooth, cylindrical inner and outer surfaces.

Following this, one or two of the bedding tapes 54 and 56 is wrapped around, encloses and engages the outer surface of the malleable tube 20. These bedding tapes are applied with the rubber thereon in the uncured state.

Next, the armor sheath 24 is helically wrapped under tension around the bedding tapes and thereby encloses and engages them firmly. The rubber on the bedding tapes is still in the uncured state, and while somewhat viscous, is incompressible and therefore deformable and flowable. Accordingly, when the armor sheath is applied with tension, the helical ridge 76 on the inner surface as seen in FIG. 4 pushes into and deforms the rubber layer 64 on the outer bedding tape 56 as well as the rubber layer 60 on the inner bedding tape 54. The excess of the rubber layers tends to flow outwardly into the helical recess 78 on the inner surface of the armor sheath.

Then, the entire combination of the power conduits, filler material, handling film, malleable tube, bedding tapes and armor sheath are heated for several hours at about 300° F. Due to this heating, the deformable nature of the malleable lead tube 20 and the transverse rigidity of the armor sheath, a thermally outward expansion and vulcanization of the filler material 38 results, as well as an outward expansion of the malleable tube under the influence of the expanding filler material. Since the armor sheath has a lower coefficient of thermal expansion than the malleable tube and is transversely rigid, and since the tube outer surface is dimensioned adjacent the inner surface of the sheath as seen in FIG. 4, a great force builds up between the expanding malleable tube and the restraining armor sheath. This causes the helically grooved contour on the inner surface 70 of the armor sheath 26 to be impressed into the outer surface 42 of the malleable tube 20 as seen in FIG. 5 due to outward stretching of the tube. This permanently forms the helically grooved contour on both the inner and outer surfaces of the malleable tube via plastic deformation due to its low elastic limit. This heating also vulcanizes the rubber in bedding tapes 36, 54 and 56 and causes an outward deformation of bedding tapes 54 and 56 in a manner conforming to the deformed tube and further into the helical recess 78 in the armor sheath as also shown in FIG. 5 but preferably not completely filling the recess.

Since the contour on the inner surface of the armor sheath is impressed into the outer surface of the malleable tube, the contour formed on the malleable tube substantially conforms to the contour on the armor sheath. Moreover, the contour on the outer surface of the malleable tube interfits with the contour on the inner surface of the armor sheath so that the helical ridge on the malleable tube is received in, but does not contact, the helical recess in the armor sheath and extends outwardly beyond the innermost part of the armor sheath helical ridge. Likewise, the helical ridge on the armor sheath is received in, but does not contact, the helical recess in the malleable tube and extends inwardly beyond the outermost part of the tube helical ridge.

Finally, the combined power conduits, filler material, handling film, malleable tube, bedding tape and armor sheath are cooled and the outer cover 26 is applied.

Upon cooling, the filler material will slightly contract. The malleable tube 20 will then rest in a slightly loose envelope or space between the cured bedding tapes and the cured filler material. It will also retain its helically grooved contour which will remain interfitted, or spirally interlocked, with the helically grooved contour on the armor sheath, much like a loosely threaded bolt engages the internal threads of a nut. However, the malleable tube will not be in direct contact with the armor sheath at any point, being fully sheathed in the cured bedding tapes interposed therebetween.

Thus, the interfitting of the malleable tube with the armor sheath assures support of the malleable tube in the vertical position when the armor sheath is attached to a support structure and the entire cable extends downwardly into a well. The helically grooved inner surface of the malleable tube also engages and receives the vulcanized filler material therein to resist relative axial movement therebetween.

In addition, the continuous, cured bedding tapes fully protect the malleable tube from direct chemical attack because they form a continuous fitting seal between the armor sheath and the malleable tube. Moreover, if hydrocarbons are present in the well, such as crude oil hydrocarbons, the rubber in the bedding tapes will gently swell up and further improve the seal between the malleable tube and armor sheath.

Finally, since the malleable tube is enclosed in a perfectly fitting but somewhat loose envelope, the malleable tube can uniformly distribute the bending stresses throughout its structure. In addition, because the malleable tube is now in a deformed configuration, it will flex in the mode of a bellows rather than as a straight lead pipe. This mode of flexing naturally produces lower levels of stress while distributing the bending stresses more uniformly over the entire malleable tube.

While one advantageous embodiment has been chosen to illustrate the invention, it will be understood by those skilled in the art that various changes and modifications can be made therein without departing from the scope of the invention as defined in the appended claims.

What is claimed is:

1. A reinforced power cable comprising:

a continuous armor sheath having a corrugated inner surface defining a cavity therein, said armor sheath having a longitudinal axis and being substantally rigid transversely of said longitudinal axis;

power conveying means, located in said cavity and extending along said longitudinal axis, for transmitting power;

filler means enclosing and engaging said power conveying means;

a malleable tube having an inner surface and an outer surface and a continuous cross section throughout its axial length, said tube inner surface enclosing and engaging said filler means, said tube outer surface being inwardly spaced from said armor sheath inner surface and being corrugated, said tube corrugated outer surface having substantially the same configuration as said armor sheath corrugated inner surface and being interlocked therewith, thereby restraining relative longitudinal movement between said tube and said armor sheath; and spacer means, interposed between and engaging said tube outer surface and said armor sheath inner surface, for maintaining said tube outer surface inwardly spaced from said armor sheath inner surface.

2. A reinforced power cable according to claim 1, wherein said armor sheath corrugated inner surface comprises an inner helical ridge and an inner helical recess, and said tube corrugated outer surface comprises an outer helical ridge and an outer helical recess.

3. A reinforced power cable according to claim 2, wherein said tube inner surface is corrugated.

4. A reinforced power cable according to claim 3, wherein said tube corrugated inner surface comprises a second inner helical ridge and a second inner helical recess.

5. A reinforced power cable according to claim 3, wherein said tube corrugated inner surface has substantially the same configuration as said tube corrugated outer surface.

6. A reinforced power cable according to claim 1, wherein said tube inner surface is corrugated.

7. A reinforced power cable according to claim 1, wherein said power conveying means comprises a plurality of insulated electrical conductors.

8. A reinforced power cable according to claim 1, wherein said power conveying means comprises an electrical conductor and an insulation layer enclosing said electrical conductor.

9. A reinforced power cable according to claim 8, wherein said power conveying means further comprises a metallic layer enclosing said insulation layer.

10. A reinforced power cable according to claim 9, wherein said power conveying means further comprises a bedding tape enclosing said metallic layer.

11. A reinforced power cable according to claim 1, wherein said spacer means comprises a bedding tape.

12. A reinforced power cable according to claim 1, wherein said malleable tube is formed of lead.

13. A reinforced power cable according to claim 1, wherein said armor sheath has a corrugated outer surface.

14. A reinforced power cable according to claim 13, wherein said armor sheath corrugated outer surface has an outer cover thereon.

15. A reinforced power cable comprising:

a continuous armor sheath having a contoured inner surface defining a cavity therein, said armor sheath having a longitudinal axis and being substantially rigid transversely of said longitudinal axis;

power conveying means, located in said cavity and extending along said longitudinal axis, for transmitting power;

filler means enclosing and engaging said power conveying means;

a continuous malleable tube having an inner surface and an outer surface, said tube inner surface enclosing and engaging said filler means, said tube outer surface being inwardly spaced from said armor sheath inner surface and being contoured, said tube contoured outer surface having substantially the same configuration as said armor sheath contoured inner surface and being interfitted therewith; and spacer means, interposed between and engaging said tube outer surface and said armor sheath inner surface, for maintaining said tube outer surface inwardly spaced from said armor sheath inner surface, said power conveying means comprising an electrical conductor and an insulation layer enclosing said electrical conductor, said power conveying means further comprising a chemical layer enclosing said electrical conductor.

16. A reinforced power cable comprising:

a continuous armor sheath having a contoured inner surface defining a cavity therein, said armor sheath having a longitudinal axis and being substantially rigid transversely of said longitudinal axis;

power conveying means, located in said cavity, and extending along said longitudinal axis, for transmitting power;

filler means enclosing and engaging said power conveying means;

a continuous malleable tube having an inner surface and an outer surface, said tube inner surface enclosing and engaging said filler means, said tube outer surface being outwardly spaced from said armor sheath inner surface and being contoured, said tube contoured outer surface having substantially the same configuration as said armor sheath contoured inner surface and being interfitted therewith; and spacer means, interposed between and engaging said tube outer surface and said armor sheath inner surface, for maintaining said tube outer surface inwardly spaced from said armor sheath inner surface, said filler means comprising a vulcanized filler material.

17. A reinforced power cable according to claim 16, wherein said filler means further comprises a plastic handling film interposed between said vulcanized filler material and said malleable tube.

18. A reinforced power cable comprising:

a continuous armor sheath having a contoured inner surface defining a cavity therein, said armor sheath having a longitudinal axis and being substantially rigid transversely of said longitudinal axis;

power conveying means, located in said cavity and extending along said longitudinal axis, for transmitting power;

filler means enclosing and engaging said power conveying means;

a continuous malleable tube having an inner surface and an outer surface, said tube inner surface enclosing and engaging said filler means, said tube outer surface being inwardly spaced from said armor sheath inner surface and being contoured, said tube contoured outer surface having substantially the same configuration as said armor sheath contoured inner surface and being interfitted therewith; and spacer means, interposed between and engaging said tube outer surface and said armor sheath inner surface, for maintaining said tube outer surface inwardly spaced from said armor sheath inner surface, said spacer means comprising a bedding tape comprising a fabric backing tape and a vulcanized material engaged therewith.

19. A reinforced power cable comprising:

a continuous armor sheath having a contoured inner surface defining a cavity therein, said armor sheath having a longitudinal axis and being substantially rigid transversely of said longitudinal axis;

power conveying means, located in said cavity and extending along said longitudinal axis, for transmitting power;

filler means enclosing and engaging said power conveying means;

a continuous malleable tube having an inner surface and an outer surface, said tube inner surface enclosing and engaging said filler means, said tube outer surface being inwardly spaced from said armor sheath inner surface and being contoured, said tube contoured outer surface having substantially the same configuration as said armor sheath contoured inner surface and being interfitted therewith; and spacer means, interposed between and engaging said tube outer surface and said armor sheath inner surface, for maintaining said tube outer surface inwardly spaced from said armor sheath inner surface, said spacer means comprising first and second bedding tapes.

20. A method of making a reinforced power cable comprising the steps of enclosing a power conveying line with vulcanizable filler material, enclosing the filler material with a continuous malleable tube, enclosing the malleable tube with a continuous, substantially transversely rigid armor sheath having a contoured inner surface, heating the power conveying line, filler material, malleable tube and armor sheath, thereby thermally outwardly expanding and vulcanizing the filler material, and outwardly expanding the malleable tube under the influence of the expanding filler material so that the contour on the inner surface of the armor sheath is impressed into the outer surface of the malleable tube, and cooling the power conveying line, filler material, malleable tube and armor sheath.

21. A method according to claim 20, wherein the second enclosing step is followed by the step of enclosing the malleable tube with a bedding tape.

22. A method of making a reinforced power cable comprising the steps of enclosing and engaging a power conveying line with a vulcanizable filler assembly, enclosing and engaging the filler assembly with a continuous malleable tube, enclosing and engaging the malleable tube with a bedding tape, enclosing and engaging the bedding tape with a continuous, substantially transversely rigid armor sheath having a contoured inner surface, heating the power conveying line, filler assembly, malleable tube, bedding tape and armor sheath, thereby thermally outwardly expanding and vulcanizing the filler assembly, and outwardly expanding the malleable tube under the influence of the expanding filler assembly so that the contour on the inner surface of the armor sheath is impressed into the outer surface of the malleable tube, and cooling the power conveying line, filler assembly, malleable tube, bedding tape and armor sheath.

23. A method according to claim 22, wherein the third enclosing and engaging step is followed by the step of enclosing and engaging the bedding tape with a second bedding tape.

24. A method according to claim 22, wherein the first enclosing and engaging step comprises the steps of enclosing and engaging the power conveying line with a vulcanizable filler material and enclosing and engaging the filler material with a handling film.

* * * * *